US005487548A

United States Patent [19]

Daly et al.

[11] Patent Number: 5,487,548

[45] Date of Patent: Jan. 30, 1996

[54] QUESTION AND ANSWER BOARD GAME REPRESENTING SNOOKER

[76] Inventors: Thomas M. Daly; Rita Daly, both of 87 Comeragh Park, Dillions Cross, Cork City, Ireland

[21] Appl. No.: 326,810

[22] Filed: Oct. 19, 1994

Related U.S. Application Data

[63] Continuation of Ser. No. 82,518, Jun. 25, 1993, abandoned, which is a continuation of Ser. No. 870,674, Apr. 17, 1992, abandoned.

[51] Int. Cl.[6] ..... A63F 9/18

[52] U.S. Cl. ..... 273/431; 273/244

[58] Field of Search ..... 273/85 R, 243, 273/287, 244, 429, 430, 431, 432; 473/1

[56] References Cited

U.S. PATENT DOCUMENTS 2,768,047 10/1956 Strauss ..... 273/309

FOREIGN PATENT DOCUMENTS 2134801 8/1984 United Kingdom .

OTHER PUBLICATIONS

"Trivial Pursuit" Pocket Edition–Rules on Play, 1988.

*Primary Examiner*—V. Millin
*Assistant Examiner*—William M. Pierce

[57] ABSTRACT

A question and answer board game is provided simulating the pocket billiards game known as SNOOKER. The game board is designed to follow the appearance of a SNOOKER table and game pieces are provided to represent the "red" and "colored" balls used in the pocket billiards game. The game pieces are manipulated in accordance with the answering of questions contained on cards, i.e. they are "pocketed" or removed from the game board if the answers are correct. Following the hales of SNOOKER, the point value of certain of the game pieces (i.e. those corresponding to the "colored" balls) increases in ascending order depending upon the difficulty of the posed questions. Thus, by playing the game of the invention, the game of SNOOKER may be learned and enjoyed while additional knowledge may be imparted to the players.

17 Claims, 4 Drawing Sheets

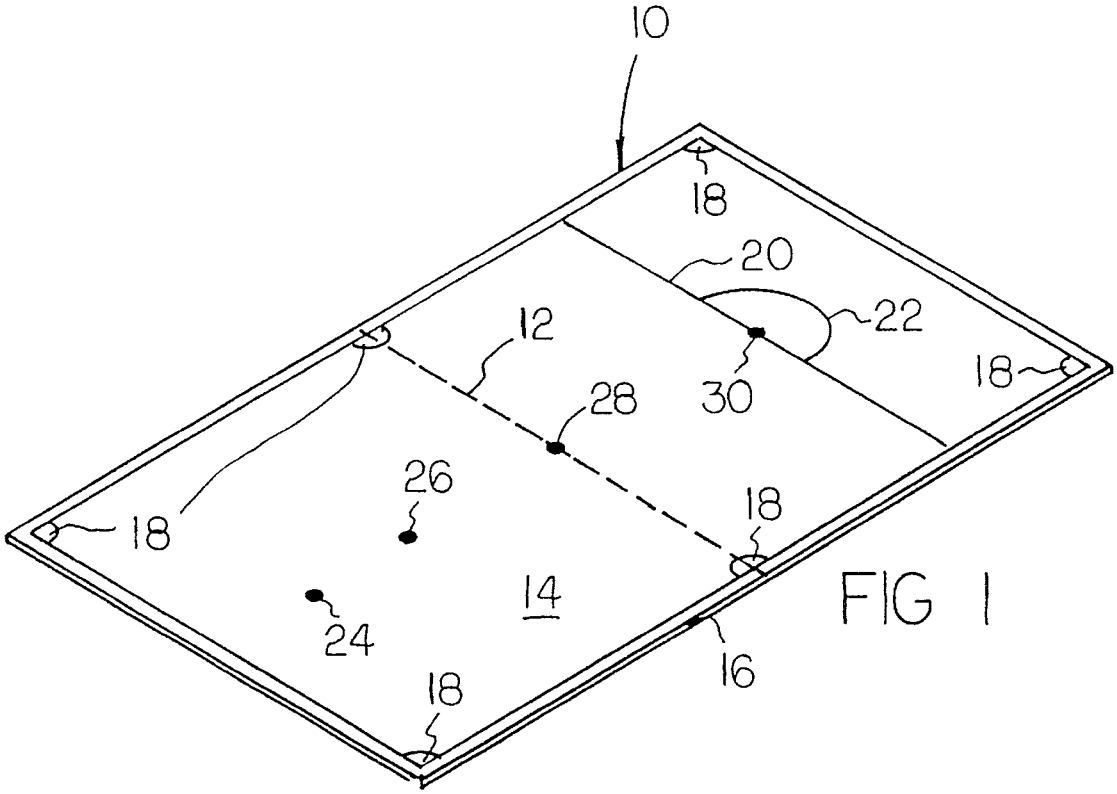
FIG 1
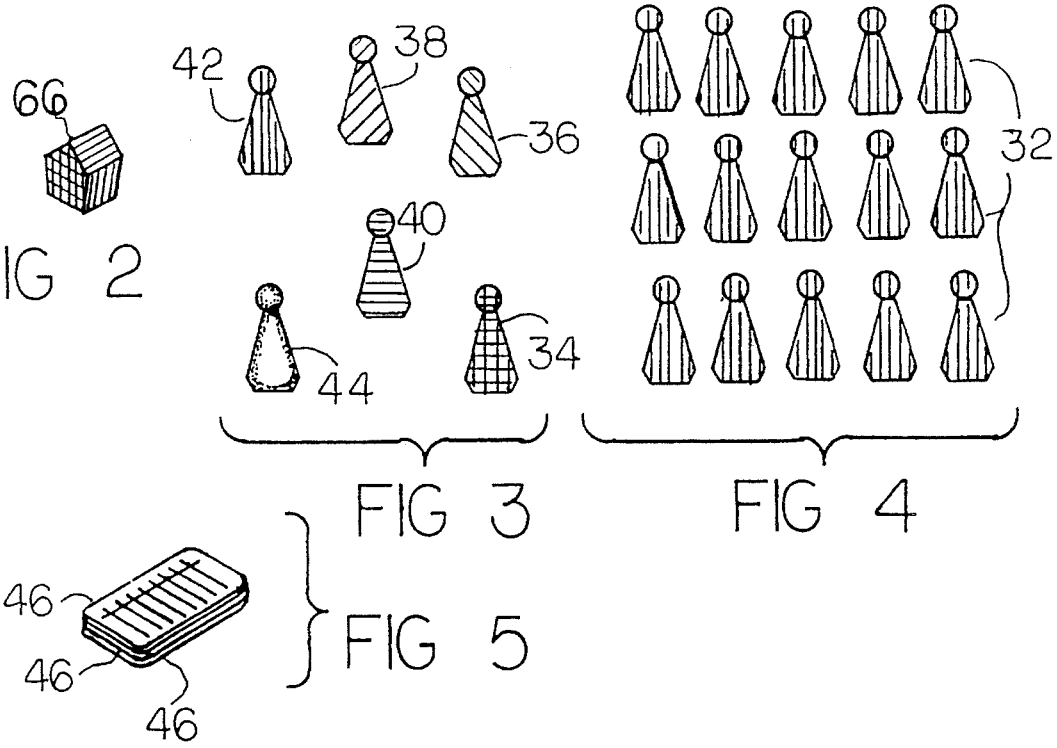
FIG 2
FIG 3
FIG 4
FIG 5

QUESTION AND ANSWER BOARD GAME REPRESENTING SNOOKER

This application is a continuation of application Ser. No. 08/082,518, filed Jun. 25, 1993, now abandoned which is a continuation of application Ser. No. 07/870,674, filed Apr. 17, 1992, now abandoned.

BACKGROUND OF THE INVENTION

1. Field of the Invention

The present invention relates generally to amusement devices and, more particularly, per*is to an amusement device in the form of a question and answer board game.

2. Description of the Prior Art

The pocket billiard game known as SNOOKER is played widely throughout the world, and recently has begun to achieve increasing popularity in the United States. SNOOKER is played on a pocket billiard table with a cue ball and a series of differently colored balls having ascending point values assigned to them. The object of the game is to pocket the balls in accordance with the rules in ascending point-value order until all balls are off the table (pocketed).

Question and answer board games, on the other hand, have already become enormously popular, not only as amusement devices, but as educational aids as well. The game marketed under the registered trademark TRIVIAL PURSUIT is a leading example and comprises a question and answer game involving a board with scoring pieces to record performance.

Heretofore, however, there has never been proposed or suggested a question and answer board game that simulates the pocket billiard game known as SNOOKER and which, in so doing, serves to impart additional knowledge to the players.

U.S. Pat. No. 4,928,976 relates to a word association game wherein the players select a series of categories and within a prescribed period of time write a word from each selected category which has the same first letter as that of a "playword" selected from a deck of cards. Scoring is based upon the correctness of the word in the category and whether or not other players have selected the same word within the given time span.

U.S. Pat. No. 4,907,808 relates to a question and answer board wherein the questions are based upon trivia associated with the T.V. show or movie known as STAR TREK. Progress in answering the questions is noted by movement across a board to reach certain imagined destinations and the construction of a model of the starship ENTERPRISE from various pieces awarded as each question correctly is answered.

U.S. Pat. No. 4,736,954 relates to a question and answer game wherein the answers to posed questions have associated therewith "reference codes." The correct answers are determined by correlating the codes on a surface representation (e.g. a map) having subdivisions matching the codes by viewing through optical means. Categories and/or difficulty of question are selected by chance using a six-sided die, for example.

U.S. Pat. No. 4,678,188 relates to a body structure having a series of question beating sides. In each side is a window and behind each side is a slidable card bearing correct answers to the question on that corresponding side, with the answers being viewable through the window when the card is manipulated. Each side has a different category of questions and selection means are provided (e.g. a spinner) to choose a side by chance.

U.S. Pat. No. 4,635,939 relates to a question and answer card game wherein the posed questions contained on a card and the correct answers disposed on another card are associated with moral issues. The players attempt to answer the posed questions by playing the "answer" cards dealt to them by a dealer. If the player's card is correct his hand is reduced by that card. If incorrect, the dealer gives the player another "answer" card. The first player to exhaust all cards from his hand "wins."

SUMMARY OF THE INVENTION

Briefly described, the question and answer board game of the present invention comprises a game board simulating a SNOOKER table, a series of game pieces positioned on the board simulating the differently colored and differently valued balls used in SNOOKER, a deck of question and answer cards, and chance selecting means in the form of a die used to determine the next question to be answered after an initial question has been successfully answered and the degree of difficulty of the next question. The object of the game is to answer correctly as many questions as possible thereby removing the corresponding game pieces from the board analogous to the manner in which the balls in SNOOKER are pocketed. Means also are provided for totaling the scores of the individual players depending upon the number and point value of the game pieces removed from the board.

The foregoing broadly outlines the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. The abstract is neither intended to define the invention of the application, which only is measured by the claims, nor is it intended to be limiting as to the scope of the invention in any way.

It is therefore an object of the present invention to provide a new and improved question and answer board game which has all the advantages of the prior art question and answer board games and none of the disadvantages.

It is another object of the present invention to provide a new and improved question and answer board game which may be easily and efficiently manufactured and marketed.

It is a further object of the present invention to provide a new and improved question and answer board game which is of a durable and reliable construction.

An even further object of the present invention is to provide a new and improved question and answer board game which is susceptible of a low cost of manufacture with regard to both materials and labor, and which accordingly is then susceptible of low prices of sale to the consuming public, thereby making such question and answer board game economically available to the buying public.

Still yet another object of the present invention is to provide a new and improved question and answer board game which is amusing to play while imparting to the players increased knowledge.

Still another object of the present invention is to provide a new and improved question and answer game which will permit the contestants to play on a board simulating the design of a SNOOKER table.

It is yet still another object of the present invention to provide a new and improved question and answer board game simulating the rules of the pocket billiard game known as SNOOKER.

These together with still other objects of the invention, along with the various features of novelty which characterize the invention, are more fully described in the following portions of the specification and pointed out with particularity in the claims annexed to and forming a part of this disclosure. For a better understanding of the invention, its operating advantages and the specific objects attained by its uses, reference should now be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become apparent when consideration is given to the following detailed description thereof. Such description makes reference to the annexed drawings wherein:

FIG. 1 is a perspective view of the game board of the present invention.

FIG. 2 is a perspective view of the question selection die used in the present invention.

FIG. 3 is a front elevational view of certain game board pieces used in the present invention.

FIG. 4 is a front elevational view of certain game board pieces used in the present invention.

FIG. 5 is a perspective view of the question and answer card deck used with the present invention.

DESCRIPTION OF THE PREFERRED EMBODIMENT

Figure 6:
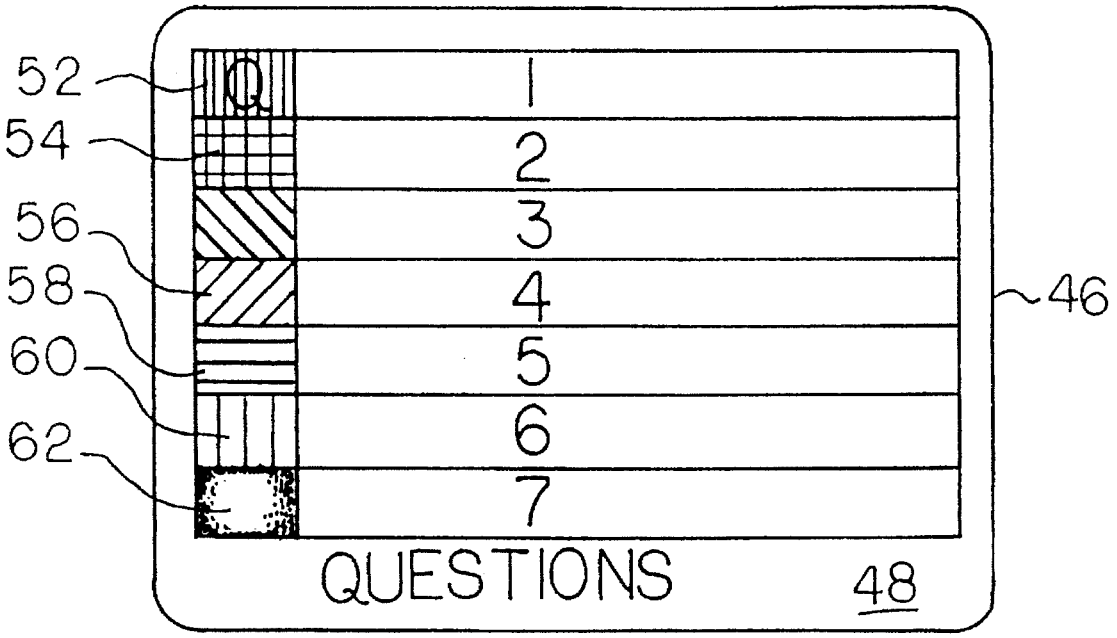
FIG. 6 is a plan view showing the details of the side of the cards of FIG. 4 bearing questions.

With reference now to the drawings, a new and improved question and answer board game embodying the principles and concepts of the present invention will be described.

Turning initially to FIGS. 1–7, the components of a first preferred form of the invention are shown. A game board 10 (FIG. 1) is provided of generally rectangular shape and preferably, is foldable along a central crease or fold line 12 for compact storage within a storage or packing box (not shown). In accordance with the invention, the board 10 is designed to simulate the layout of an actual pocket billiards SNOOKER table and to that end, preferably features a green field 14 surrounded by a red border 16. Six circular segments 18 preferably of a black or dark color are positioned substantially as shown to simulate the pockets of the billiard table. A transverse line 20 extends across the board about a fifth of the way from one end and is intercepted by a centrally disposed semi-circle 22. The line 20 represents the "balk" line whereas the semi-circle 22 defines the "D" of a conventional SNOOKER table layout as is well known. Finally, the board 10 comprises a series of four (4) centrally aligned black dots 24, 26, 28 and 30 which on an actual SNOOKER table would represent the locations for certain colored SNOOKER balls of ascending point value when the balls are racked at the start of each game or inning as will be more particularly described.

In an actual SNOOKER game, there are 22 balls consisting of one (1) cue ball, fifteen (15) red balls each having an assigned value of one (1) point, and six (6) differently colored balls respectively having assigned ascending point values as follows:

yellow=2 green=3 brown=4 blue=5 pink=15 black=7

If board 10 were an actual SNOOKER table and one wished to rack the table at the start of a game, typically the 15 red balls would be racked with the apex of the triangle on spot 26; the black ball would be placed on spot 24; the pink ball would be placed touching and in front of the red ball on spot 26; the blue ball would be placed on spot 28; the brown ball on spot 30; the yellow ball would be placed on the spot defined by the intersection of the D and the balk line to the left of spot 30 as viewed in FIG. 1; and the green ball would be placed on the spot defined by the intersection of the D and the balk line to the right of spot 30 as viewed in FIG. 1.

In the board game of the present invention, the game pieces shown in FIGS. 3 and 4 are used to simulate the "red" and the "colored" SNOOKER bails. Thus, in FIG. 4 there are fifteen (15) similarly shaped and sized "red" game pieces 32 each having an assigned point value of 1. In FIG. 3 there are six (6) similarly shaped and sized game pieces of differing colors having assigned differing point values respectively as follows:

piece 34=yellow=2 piece 36=green=3 piece 38=brown=4 piece 40=blue=5 piece 42=pink=6 piece 44=black=7

Except for their color, game pieces 32–44 may be identical and fabricated from molded plastic or wood. Preferably, they assume the shape substantially as shown in FIGS. 3 and 4.

It thus will be appreciated that in setting up the game board of the present invention prior to beginning play, the pieces 32–44 are arranged on the board in the same manner as actual SNOOKER balls are placed on a SNOOKER table with the game pieces taking the place of the actual racked and positioned balls.

Figure 7:
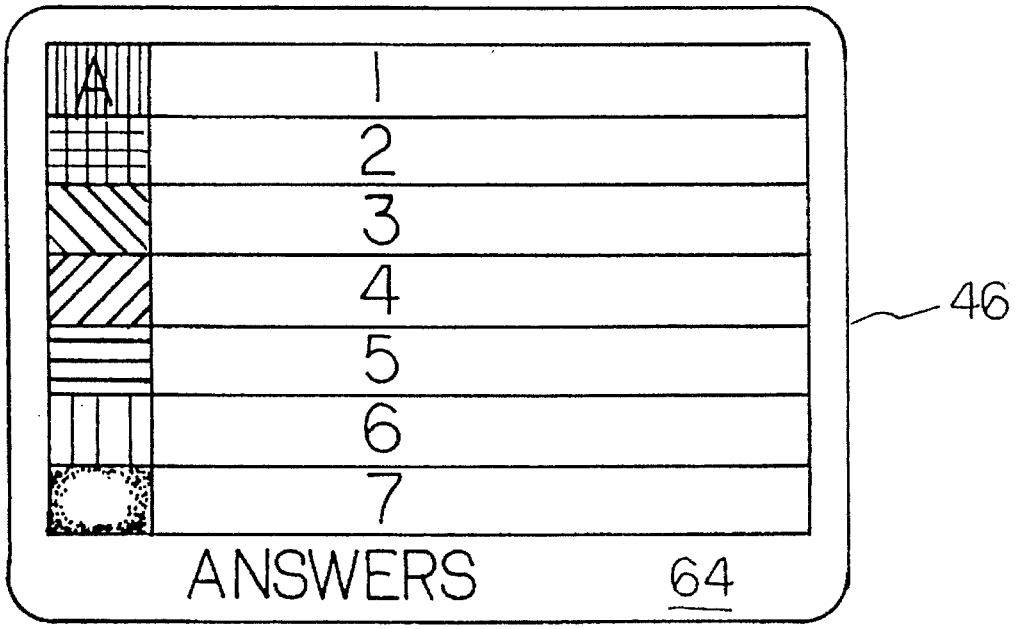
FIG. 7 is a plan view showing the details of the side of the cards of FIG. 4 bearing answers to the questions on the obverse side.

Turning now to FIGS. 5–7, the question and answer game cards 46 will be described. The game cards 46 simulate the cue and cue ball used in SNOOKER and are structurally similar to each other in size and shape so as to form a conveniently handled "deck" (FIG. 5). Any reasonable number of cards may be provided in the deck, and several different decks may be used. Each card 46 includes an obverse face 48 and a reverse face 64 (FIG. 7). The obverse side 48 of each card 46 has printed thereon or in any other suitable manner displays a series of seven (7) questions preferably arranged from top to bottom as indicated by the arabic numerals 1–7 in FIG. 6. To the left of each question is a color-coded block or other space 50, 52, 54, 56, 58, 60, and 62 associating the questions with the colors of game pieces 32, 34, 36, 38, 40, 42 and 44, respectively. It is to be noted that the intellectual content of the questions on the obverse side 48 of each game card 46 is entirely arbitrary and forms no part of the present invention. Thus, the questions may relate to any category of subject matter such as trivia, sports, geography, history, and so on. The only requirement of the invention in this regard is that the questions become increasingly more difficult as they range from top to bottom of each card, i.e. question 1 is easiest, question 7 most difficult. Nor is it required that the questions on each obverse card face be devoted to the same category. They may be intermixed by category, as long as the ascending order of difficulty is adhered to. The reason for this will become apparent when it is noted that colored blocks or spaces 52, 54, 56, 58, 60 and 62 on each card obverse face 48 are as follows, respectively;

red yellow green brown blue pink black and thus correspond to the same ascending point value as defined by the color coding of game pieces 32, 34, 36,38, 40, 42 and 44, respectively (e.g., red=1, black=7). In other words, the difficulty of each question on the obverse face 48 of each card 46 is, in accordance with the present invention, associated with the same ascending point value as that of the simulated game pieces 32–44 and therefore, of the actual "red" and "colored" balls in SNOOKER.

On the reverse side 64 of each game card 46 (FIG. 7) are displayed in corresponding order the "ANSWERS" to the questions on the obverse side and the same color coding scheme regarding degree of difficulty. Thus, the answer to any posed question may be determined easily and rapidly by merely flipping each card over. If a posed question is answered correctly, the game piece corresponding to that question may be removed from the game board simulating the pocketing of a SNOOKER ball.

Under the rules of the game of the present invention, each player commences a game or inning by first attempting to correctly answer a question on a given card 46 corresponding to the "red" game pieces each of which has a point value=1, i.e. the easiest or first question on the obverse face 48 of the card 46. If the player correctly answers the "red" question (corresponding to pocketing a "red" ball in SNOOKER), he or she receives 1 point and then, and only then, may attempt to answer a question of higher point value or, synonymously, of a greater degree of difficulty (corresponding to attempting to pocket a "colored" ball in SNOOKER).

In accordance with the invention, chance selection means are provided for selecting the next question to be answered after a "red" question has been correctly answered. In the preferred embodiment, the chance selection means is in the form of a seven (7) sided die 66 wherein each of the seven sides has a different color. corresponding to red, yellow, green, brown, blue, pink, and black, respectively. By this arrangement, each of the seven colored sides of die 66 will also have associated with it, respectively, the same point values assigned to the "colored" game pieces and the questions 1 through 7 on each card obverse face 46 as described above. Thus, when the die 66 is tossed, the colored side facing up will indicate the color cede for the next question, e.g. if "pink" faces up, the next question will have a point value=6, and this question will appear on line 6 of the question card obverse face 48 having the "pink" color-coded block 60. To determine if the answer to question 6 is correct, the card is turned over to its reverse face 64 where the correct answer will be found on line 6 next to a corresponding "pink" color-coded block. As mentioned above, correctly answering a question having a point value greater than=1simulates pocketing a colored SNOOKER ball and the point value of the correctly answered question is added to the player's score. A player continues to use the chance selection means (die 66) until all questions on the card are answered correctly, or until a question cannot be answered correctly, whichever occurs first. The next player then "racks" the SNOOKER table (i.e. game board 10) by replacing any removed game pieces and selects another answer card 46 from the deck to start a new game or inning.

The chance selection means or die 66 also may be used to determine order of play among a plurality or group of players since each of the colored faces of the die 66 has a point value assigned to it. Thus, for example, the red face=1, the yellow face=2, the black face=7, and so on. Hence, each player may toss the die in turn to determine order of play with, for example, the highest point value commencing play first, the next highest commencing play second, and so on.

Figure 8:
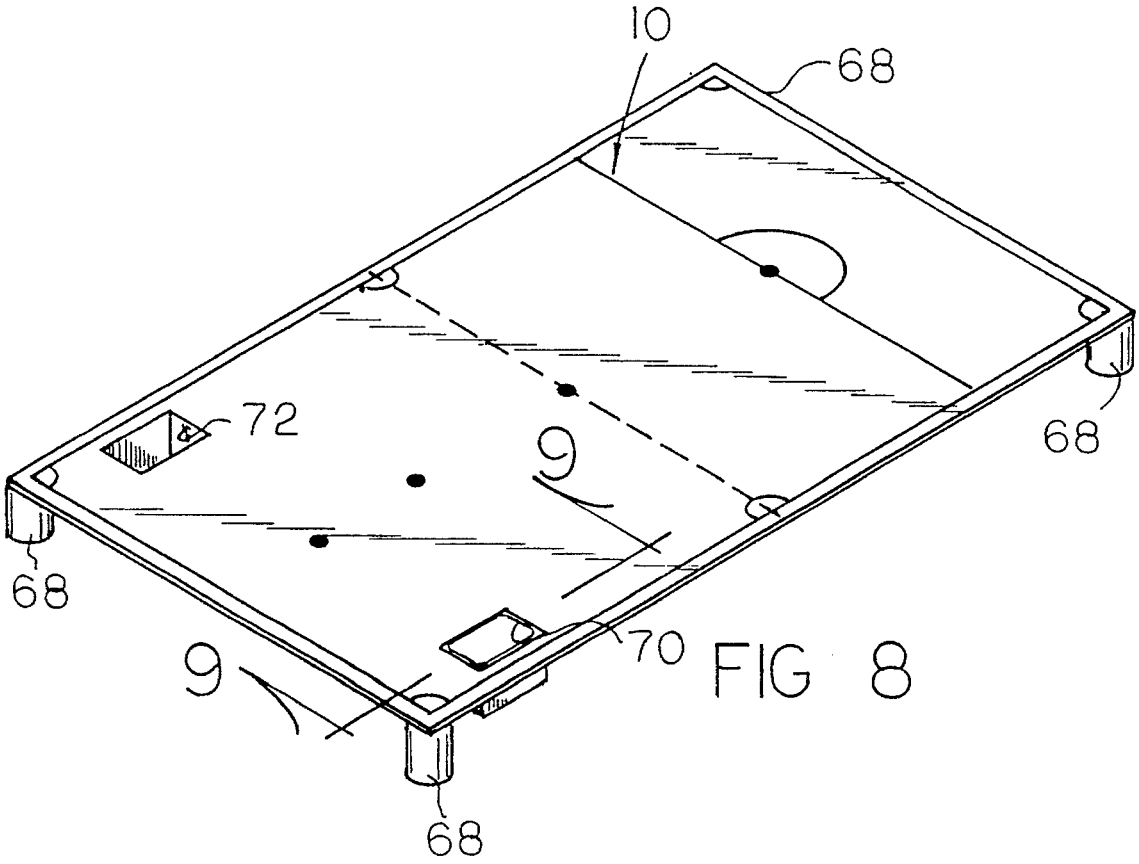
FIG. 8 is a perspective view showing an alternatively preferred form of game board used with the present invention.
Figure 9:
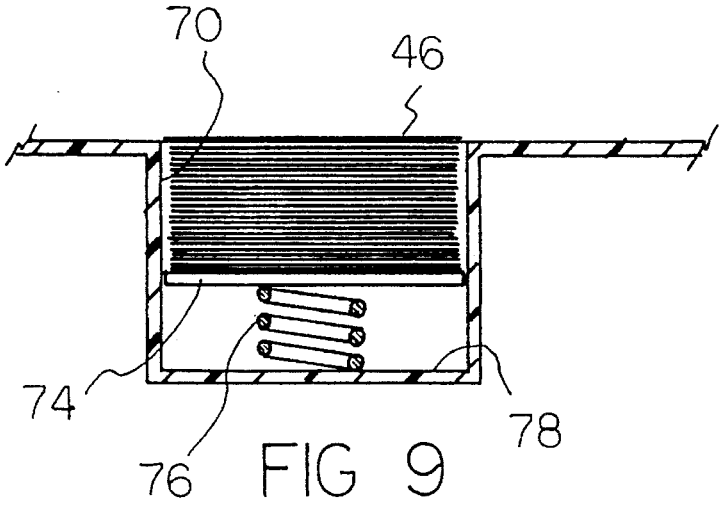
FIG. 9 is a front elevational sectional view taken along line 9—9 of FIG. 8.
Figure 10:
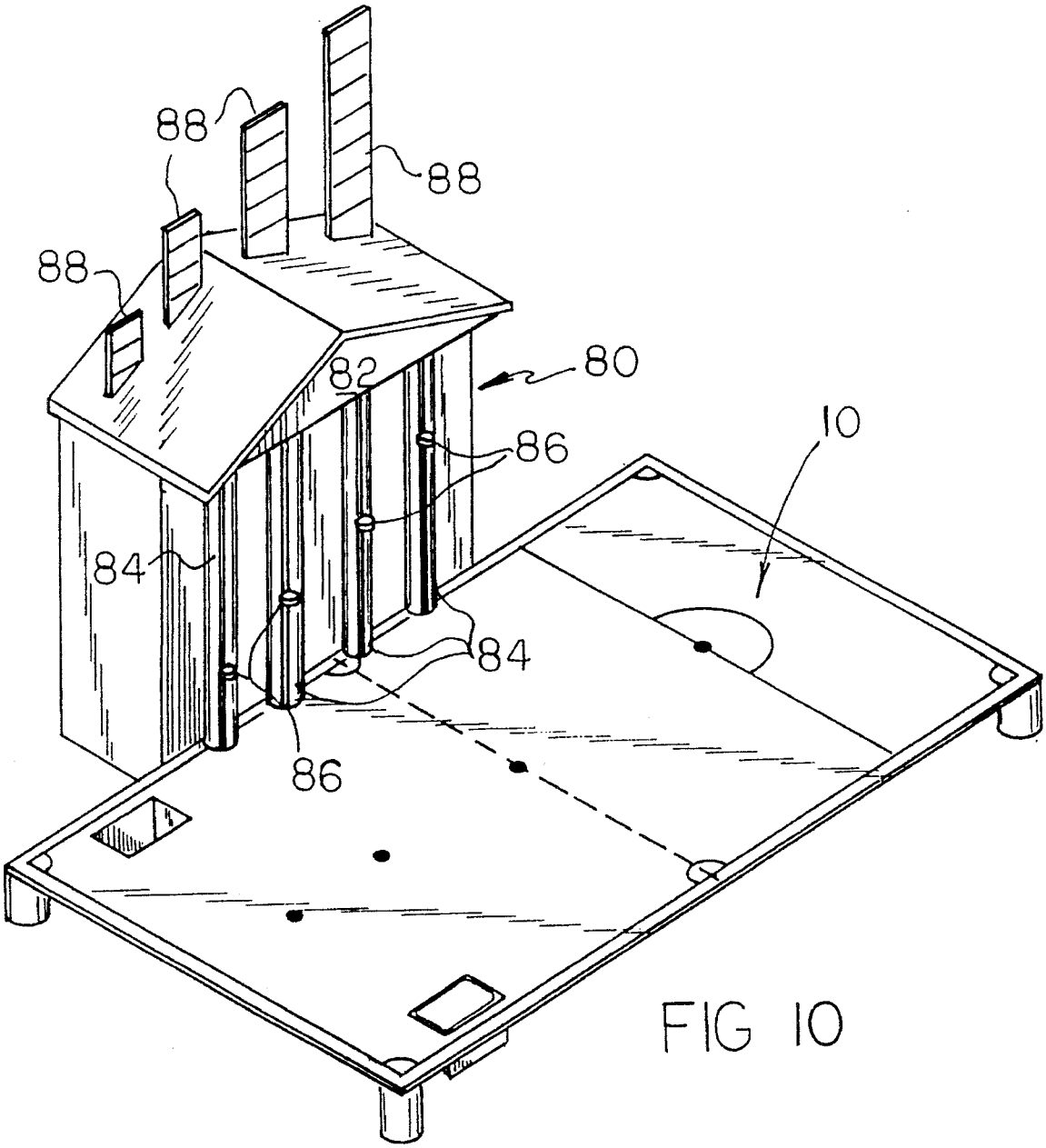
FIG. 10 is a perspective view showing question answering scoring means used with the alternative embodiment of the invention.

Turning now to FIGS. 8–10, where like reference numerals represent like parts, there is shown an alternative form of the present invention. In its alternative preferred form, game board 10 is mounted on four legs 68 at each corner thereof to simulate a raised SNOOKER table. In addition, there is provided a pair of receptacles 70, 72 positioned respectively in the surface of game board 10 near the opposed, longitudinally extending sides thereof substantially as shown. Receptacles 70, 72 serve as convenient storage means for question and answer cards 46. As shown in FIG. 9, each receptacle 70, 72 includes an elevator platform 74 attached to a compression spring 76 fixed to the floor 78 of the receptacle. By the action of this arrangement, a new or next question/answer card 46 conveniently may be presented to the players from, say, receptacle 70. When an inning is over and the card 46 is no longer in use, it may temporarily be stored in the other receptacle 72.

In recording the progress of a player, any suitable scoring means may be used. For example, the scores of each player may be recorded by adding the point value of all questions answered correctly each inning and noting the sum in a column on a piece of paper under each player's name. In the preferred embodiment of FIGS. 8–10, however, a mechanical scoring device generally represented by reference numeral 80 is preferably provided. Scoring device 80 is in the form of a housing having a neoclassical get-up to suggest an academic institution (i.e. college or university). In this regard, note the arch 82 and columns 84. Each column 84 represents a different . player (while four (4) are shown, any number may be provided), and includes a finger tab 86 movable within a longitudinal slot in each column. Each tab is mechanically connected inside housing 80 in a known manner to a slide 88 extending upwardly . through the roof of the housing. Slides 88 bear suitable markings or indicia thereon to indicate each corresponding player's score, i.e. the Slide markings could indicate level of achievement such as Bachelor's Degree, Master's Degree, Ph.D., or have numerical grades ranging from a minimum to a maximum, and so on. When the game begins, all tabs 86 will be in their bottommost position, and as each player's score. accumulates, the tabs 86 and slides 88 will be moved upwardly in corresponding fashion to reveal each player's progress. It will be noted in FIG. 10 that the length of columns 84 is sized so that the bottom and surfaces of the columns abut the upper surface of game board 10 when the scoring device 80 is positioned adjacent the board substantially as shown. This permits a compact and convenient arrangement between the game board and scoring device facilitating increased enjoyment during use.

In playing the question and answer board game of the present invention, the following "rules" are preferred:

(1) The game pieces initially are positioned on the game board following typical rules for racking a SNOOKER table (as described above).

(2) The chance selection means (e.g. 7-sided die 66) is thrown in turn by each player to determine order of play (highest number goes first, followed by next highest, etc.).

(3) Each player must start an inning by first attempting to answer the easiest or "red" question on a selected card.

(4) If the "red" question on a given card is incorrectly answered, the inning is over and the next player takes his/her turn.

(5) If the "red question" on a given card is correctly answered, a "red" piece is removed from the board and the chance selection means thrown to determine the next question to be answered on a given card (or a different card) by that player. (Die is thrown again if the next question comes up "red," i.e. "next" question must be a color other than "red.")

(6) If the next question is answered correctly, the corresponding point value is noted and added to the player's score. In addition, the game piece corresponding to the color of the correctly answered question is removed from the board.

(7) A player follows the procedure of (6) until he/she fails to answer a question or all colored game pieces other than "red" are removed from the board whichever comes first.

(8) Only the colored game pieces are repositioned on the board following completion of an inning.

(9) The game ends when all "red" pieces have been removed from the board and the last player's inning is over.

(10) The player with the highest cumulative score at the end of the game is declared the winner.

(11) Any reasonable number of players may participate; however, 2–4 players are preferred.

While the above "rules" of the board game of the present invention may be presented in any suitable manner, it is preferred that they be printed on the inside cover of the packing box or carton (not shown) in which the game board 10, the question and answer cards 46, the game pieces 32 through 44, the chance selection means 66, and any other parts, are stored.

It will be appreciated from the above description that, by playing the question and answer game board of the present invention, the pocket billiard game of SNOOKER may be simulated with each correctly answered question being analogous to the pocketing of a "red" or "colored" SNOOKER ball. The same point value schemes are employed and the object of both games is the same, i.e. achieve the highest total score. Playing the question and answer board game of the present invention thus not only offers enjoyment similar to that which one would receive from experiencing an actual game of SNOOKER, but furthermore, leads to enhanced knowledge. It is thus seen that all of the objects and advantages of the invention may successfully be achieved.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. For example, instead of using chance selection means in the form of the 7-sided die 66, a spinnable arrow supported on a card having a circular design with seven color-coded segments may be employed instead. Still other obvious modifications or alterations will occur to those of ordinary skill in the art.

What is claimed as being new and desired to be protected by Letters Patent of the United States is as follows:

1. A method of playing a question and answer board game comprising the following steps:

(a) providing game board means simulating a SNOOKER table;

(b) providing twenty-one game board pieces positionable on said game board means, said game pieces having the same colors respectively as the balls used in SNOOKER and including fifteen red game board pieces, one yellow game board piece, one green game board piece, one brown game board piece, one blue game board piece, one pink game board piece, and one black game board piece;

(c) assigning ascending point values to said game pieces as follows:

red=1
yellow=2
green=3
brown=4
blue=5 pink=6
black=7

(d) providing a series of seven questions ranging in difficulty from easiest to most difficult, the seven questions being labeled in order of ascending difficulty as red, yellow, green, brown, blue, pink, and black;

(e) permitting a player to attempt to answer the easiest question in said series, said easiest question being a red question;

(f) permitting said player to attempt to answer a second question in said series of questions if said player answers said easiest question correctly, said second question being more difficult than said easiest question, said second question being selected by chance from said series of questions, wherein said second question must be a color question selected from the group consisting of yellow, green, brown, blue, pink, and black;

(g) assigning point values to said questions in said series, said point values ascending in accordance with difficulty and being equal to said point values assigned to said colors in step (c);

(h) deriving said player's score by summing together the point values of the questions in said series correctly answered by said player;

(i) associating the game board pieces and their respective colors with the point values assigned to said series of questions;

(j) removing the game pieces from said board when a corresponding question is correctly answered by an individual player;

(k) permitting said player to attempt to answer a third question in said series of questions if said player answers said second question correctly, said second question being selected by chance from said series of questions, wherein said second question must be a color question selected from the group consisting of yellow, green, brown, blue, pink, and black.

2. The method of playing a question and answer board game of claim 1, and further comprising the step of:

repositioning removed colored game pieces onto said board when a question is incorrectly answered by an individual player, said colored game pieces being selected from the group consisting of yellow, green, brown, blue, pink, and black.

3. The method of playing a question and answer board game of claim 2, wherein step (k) comprises providing a second series of seven questions ranging in difficulty from easiest to most difficult; and permitting said player to select said third question from said second series of questions.

4. A method of playing a question and answer board game comprising the following steps:

(a) providing game board simulating a SNOOKER table;

(b) providing twenty-one game board pieces positionable on the game board, the game pieces having the same colors respectively as balls used in SNOOKER and including fifteen red game board pieces and six colored game board pieces, the colored game board pieces including one yellow game board piece, one green game board piece, one brown game board piece, one blue game board piece, one pink game board piece, and one black game board piece;

(c) assigning ascending point values to the game board pieces as follows: red=1, yellow=2, green=3, brown=4, blue=5, pink=6, and black=7;

(d) providing a first series of seven questions printed on a first card and ranging in difficulty from easiest to most difficult, the seven questions being labeled in order of ascending difficulty as a red question, a yellow question, a green question, a brown question, a blue question, a pink question, and a black question;

(e) permitting a first player to attempt to answer the red question in the first series;

(f) removing a red game board piece from the board if the first player correctly answers the red question in the first series of questions;

(g) awarding a point to the first player in accordance with the point values assigned to the game pieces in step (c);

(h) permitting the first player to attempt to answer a second question if the player answers the red question correctly, the second question being more difficult than the red question and being selected by chance, wherein the second question must be a color question selected from the group consisting of the yellow question, the green question, the brown question, the blue question, the pink question, and the black question;

(i) removing a colored game board piece of a corresponding color as the second question from the board if the first player correctly answers the second question;

(j) awarding points to the first player for the game board pieces just removed in accordance with the point values assigned to the game board pieces in step (c);

(k) permitting the first player to attempt to answer a third question if the player answers the second question correctly, the third question being selected by chance, wherein the third question must be a color question selected from the group consisting of the yellow question, the green question, the brown question, the blue question, the pink question, and the black question;

(l) removing a colored game board piece of a corresponding color as the third question from the board if the first player correctly answers the third question;

(m) awarding points to the first player for the game board pieces just removed in accordance with the point values assigned to the game board pieces in step (c);

(n) permitting the first player to attempt to answer a fourth question if the player answers the third question correctly, the fourth question being selected by chance, wherein the fourth question must be a color question selected from the group consisting of the yellow question, the green question, the brown question, the blue question, the pink question, and the black question;

(o) removing a colored game board piece of a corresponding color as the fourth question from the board if the first player correctly answers the fourth question;

(p) awarding points to the first player for the game board pieces just removed in accordance with the point values assigned to the game board pieces in step (c);

(q) permitting the first player to attempt to answer a fifth question if the player answers the fourth question correctly, the fifth question being selected by chance, wherein the fifth question must be a color question selected from the group consisting of the yellow question, the green question, the brown question, the blue question, the pink question, and the black question;

(r) removing a colored game board piece of a corresponding color as the fifth question from the board if the first player correctly answers the fifth question;

(s) awarding points to the first player for the game board pieces just removed in accordance with the point values assigned to the game board pieces in step (c);

(t) permitting the first player to attempt to answer a sixth question if the player answers the fifth question correctly, the sixth question being selected by chance, wherein the sixth question must be a color question selected from the group consisting of the yellow question, the green question, the brown question, the blue question, the pink question, and the black question;

(u) removing a colored game board piece of a corresponding color as the sixth question from the board if the first player correctly answers the sixth question;

(v) awarding points to the first player for the game board pieces just removed in accordance with the point values assigned to the game board pieces in step (c);

(w) permitting the first player to attempt to answer a seventh question if the player answers the sixth question correctly, the seventh question being selected by chance, wherein the seventh question must be a color question selected from the group consisting of the yellow question, the green question, the brown question, the blue question, the pink question, and the black question;

(x) removing a colored game board piece of a corresponding color as the seventh question from the board if the first player correctly answers the seventh question;

(y) awarding points to the first player for the game board pieces just removed in accordance with the point values assigned to the game board pieces in step (c);

5. The method of playing a question and answer board game of claim 4, and further comprising the step of:

(z) repositioning removed colored game board pieces onto the board when a question is incorrectly answered by the first player.

6. The method of playing a question and answer board game of claim 5, wherein step (d) further comprises providing a second series of seven questions printed on a second card and ranging in difficulty from easiest to most difficult, the seven questions of the second series of seven questions being labeled in order of ascending difficulty as a red question, a yellow question, a green question, a brown question, a blue question, a pink question, and a black question; and further wherein step (h) comprises permitting said player to select the second question from the second series of seven questions of the second card.

7. The method of playing a question and answer board game of claim 6, wherein step (k) comprises permitting said player to select the third question from the second series of seven questions of the second card.

8. The method of playing a question and answer board game of claim 7, wherein step (n) comprises permitting said player to select the fourth question from the second series of seven questions of the second card.

9. The method of playing a question and answer board game of claim 8, wherein step (q) comprises permitting said player to select the fifth question from the second series of seven questions of the second card.

10. The method of playing a question and answer board game of claim 9, wherein step (t) comprises permitting said player to select the sixth question from the second series of seven questions of the second card.

11. The method of playing a question and answer board game of claim 10, wherein step (w) comprises permitting said player to select the seventh question from the second series of seven questions of the second card.

12. The method of playing a question and answer board game of claim 11, and further comprising the following steps:

(dd) providing a third series of seven questions printed on a third card and ranging in difficulty from easiest to most difficult, the seven questions being labeled in order of ascending difficulty as a red question, a yellow question, a green question, a brown question, a blue question, a pink question, and a black question;

(ee) permitting a second player to attempt to answer the red question in the first series;

(ff) removing a red game board piece from the board if the second player correctly answers the red question in the first series of questions;

(gg) awarding a point to the second player in accordance with the point values assigned to the game pieces in step (c);

(hh) permitting the second player to attempt to answer a second question if the second player answers the red question correctly, the second question being more difficult than the red question and being selected by chance, wherein the second question must be a color question selected from the group consisting of the yellow question, the green question, the brown question, the blue question, the pink question, and the black question;

(ii) removing a colored game board piece of a corresponding color as the second question from the board if the second player correctly answers the second question;

(jj) awarding points to the second player for the game board pieces just removed in accordance with the point values assigned to the game board pieces in step (c);

(kk) permitting the second player to attempt to answer a third question if the second player answers the second question correctly, the third question being selected by chance, wherein the third question must be a color question selected from the group consisting of the yellow question, the green question, the brown question, the blue question, the pink question, and the black question;

(ll) removing a colored game board piece of a corresponding color as the third question from the board if the second player correctly answers the third question;

(mm) awarding points to the second player for the game board pieces just removed in accordance with the point values assigned to the game board pieces in step (c);

(nn) permitting the second player to attempt to answer a fourth question if the second player answers the third question correctly, the fourth question being selected by chance, wherein the fourth question must be a color question selected from the group consisting of the yellow question, the green question, the brown question, the blue question, the pink question, and the black question;

(oo) removing a colored game board piece of a corresponding color as the fourth question from the board if the second player correctly answers the fourth question;

(pp) awarding points to the second player for the game board pieces just removed in accordance with the point values assigned to the game board pieces in step (c);

(qq) permitting the second player to attempt to answer a fifth question if the second player answers the fourth question correctly, the fifth question being selected by chance, wherein the fifth question must be a color question selected from the group consisting of the yellow question, the green question, the brown question, the blue question, the pink question, and the black question;

(rr) removing a colored game board piece of a corresponding color as the fifth question from the board if the second player correctly answers the fifth question;

(ss) awarding points to the second player for the game board pieces just removed in accordance with the point values assigned to the game board pieces in step (c);

(tt) permitting the second player to attempt to answer a sixth question if the player answers the fifth question correctly, the sixth question being selected by chance, wherein the sixth question must be a color question selected from the group consisting of the yellow question, the green question, the brown question, the blue question, the pink question, and the black question;

(uu) removing a colored game board piece of a corresponding color as the sixth question from the board if the second player correctly answers the sixth question;

(vv) awarding points to the first player for the game board pieces just removed in accordance with the point values assigned to the game board pieces in step (c);

(ww) permitting the second player to attempt to answer a seventh question if the second player answers the sixth question correctly, the seventh question being selected by chance, wherein the seventh question must be a color question selected from the group consisting of the yellow question, the green question, the brown question, the blue question, the pink question, and the black question;

(xx) removing a colored game board piece of a corresponding color as the seventh question from the board if the second player correctly answers the seventh question;

(yy) awarding points to the second player for the game board pieces just removed in accordance with the point values assigned to the game board pieces in step (c);

13. The method of playing a question and answer board game of claim 12, and further comprising the step of:

(zz) repositioning removed colored game board pieces onto the board when a question is incorrectly answered by the first player.

14. The method of playing a question and answer board game of claim 13, wherein step (dd) further comprises providing a second series of seven questions printed on a second card and ranging in difficulty from easiest to most difficult, the seven questions of the second series of seven questions being labeled in order of ascending difficulty as a red question, a yellow question, a green question, a brown question, a blue question, a pink question, and a black question; wherein step (hh) comprises permitting said second player to select the second question from the second series of seven questions of the second card; wherein step (kk) comprises permitting said second player to select the third question from the second series of seven questions of the second card; wherein step (nn) comprises permitting said second player to select the fourth question from the second series of seven questions of the second card; wherein step (qq) comprises permitting said second player to select the fifth question from the second series of seven questions of the second card; wherein step (tt) comprises permitting said second player to select the sixth question from the second series of seven questions of the second card; and wherein step (ww) comprises permitting said second player to select the seventh question from the second series of seven questions of the second card.

15. The method of playing a question and answer board game of claim 14, wherein the red game board pieces are never repositioned onto the game board during play of the method.

16. The method of playing a question and answer board game of claim 15, wherein selection of a question by chance comprises the steps of:

(aaa) providing a die having seven sides, each of the sides being of an individual one of the colors selected from the group consisting of yellow, green, brown, blue, pink, and black;

(bbb) rolling the die by a player;

(ccc) selecting the question corresponding to the color of the side of the die facing upwardly after step (bbb).

17. The method of playing a question and answer board game of claim 16, wherein a winner is declared as the player having a highest score subsequent to removal of all the red game board pieces from the game board and the answering of a question incorrectly.

* * * * *